United States Patent [19]

Hermann

[11] 4,102,521

[45] Jul. 25, 1978

[54] SYSTEM FOR SIGNAL CODING

[75] Inventor: Joachim Hermann, Munich, Germany

[73] Assignee: Boelkow Entwicklungen KG, Munich, Germany

[21] Appl. No.: 230,804

[22] Filed: Oct. 12, 1962

[51] Int. Cl.[2] ..... F41G 7/14; F41G 9/00; F41G 7/00

[52] U.S. Cl. ..... 244/3.11; 325/32; 178/22; 102/214

[58] Field of Search ..... 244/14, 14.55, 14 NA, 244/3.11; 102/50; 178/22; 325/32, 33, 35

[56] References Cited

U.S. PATENT DOCUMENTS

| | | | |
|---|---|---|---|
| 2,530,142 | 11/1950 | Atkins | 325/33 |
| 3,053,478 | 9/1962 | Davenport et al. | 244/14 |

FOREIGN PATENT DOCUMENTS

| | | | |
|---|---|---|---|
| 206,499 | 7/1924 | United Kingdom | 325/35 |
| 222,216 | 10/1924 | United Kingdom | 325/35 |
| 516,802 | 1/1940 | United Kingdom | 325/35 |

*Primary Examiner*—Samuel W. Engle
*Assistant Examiner*—Thomas H. Webb
*Attorney, Agent, or Firm*—Toren, McGeady and Stanger

EXEMPLARY CLAIM

1. In a system for the coding of guidance signals which are produced at a control center and after their coding transmitted to a body to be guided, a control center consisting of a command generator for producing the guidance signals, a coding unit for coding the guidance signals, a storage stage feeding the coding unit, said storage stage being controlled by a time stage, and a transmitter for transmitting the coded guidance signals to the body to be guided for actuating conrol surfaces therein, furthermore a receiver for the transmitted guidance signals, which receiver is arranged in the body to be guided, a decoding unit coupled to the receiver, a servo mechanism of the control surfaces of the body coupled to the decoding unit, a storage stage coupled to feed the decoding unit, a time stage coupled to control the storage stage, and a code generator consisting of a noise generator and two gate circuits connected therewith, one of said gate circuits being connected to the storage stage of the control center and the other gate circuit being connected to the storage stage in the body to be guided, which last connection is provided with a releasable plug which disconnects said other gate circuit when the body to be guided is launched.

4 Claims, 1 Drawing Figure

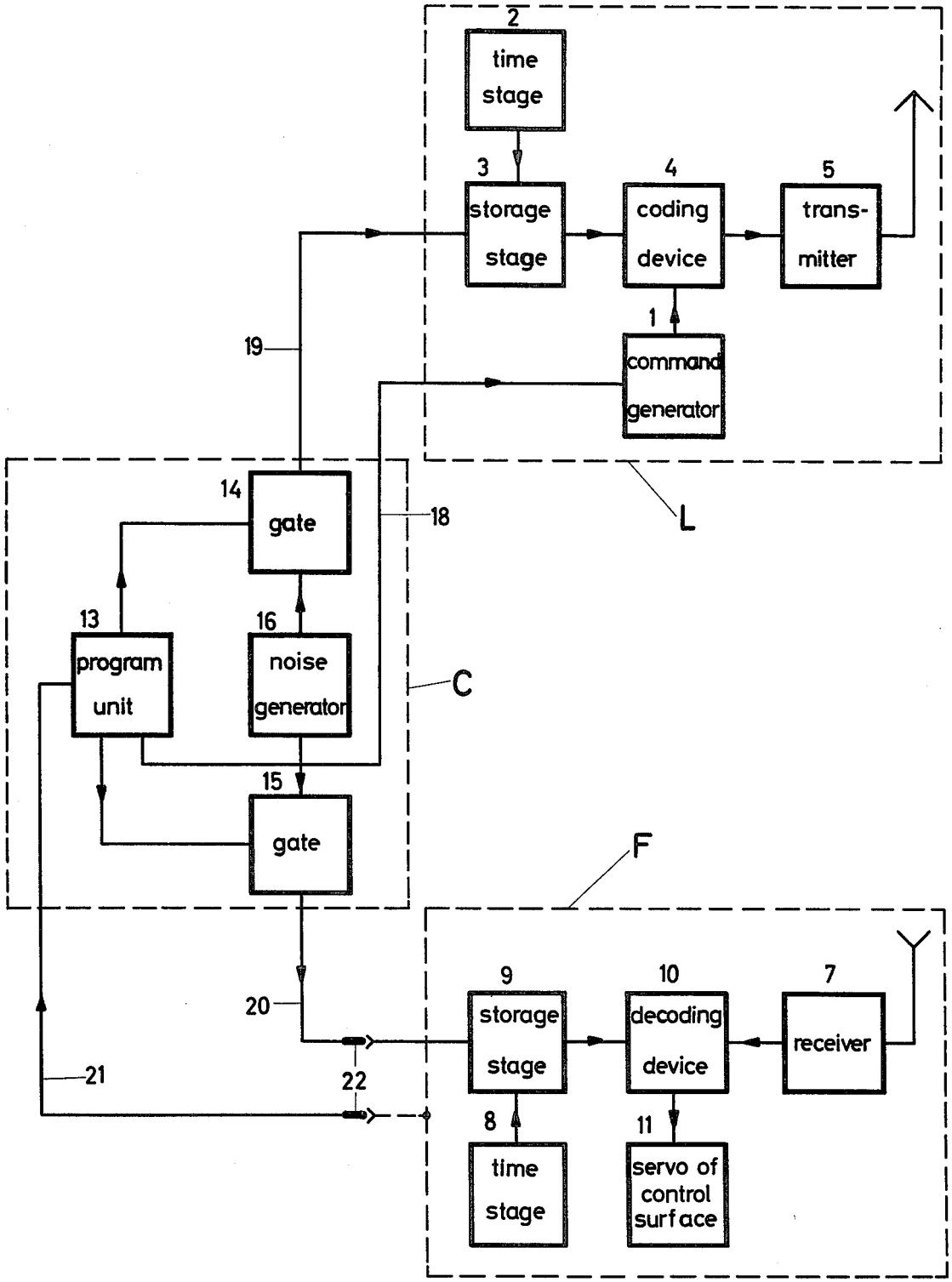
2
time stage
3
storage stage
4
coding device
5
trans-mitter
1
command generator
19
L
14
gate
18
13
program unit
16
noise generator
C
15
gate
F
20
9
storage stage
10
decoding device
7
receiver
21
22
8
time stage
11
servo of control surface

SYSTEM FOR SIGNAL CODING

The invention relates to a method and apparatus for the coding of signals by means of a code. A great number of such methods are known. Three main disadvantages, however, prevent their use in practice. On the one hand, a potential enemy to whom is disclosed the code key can decode the transmitted information, or he succeeds in decoding the used code during a transmission of information. Moreover, if he has a sufficient knowledge of the used code, he can render a signal transmission inefficient by jamming signals.

It is the object of the invention to sypply a method for coding signals, where both disclosure of the used code and decoding during a transmission of information are nearly impossible. The possibility of jamming a transmission is thus excluded nearly completely in practice.

The problem is solved by using a broad-band noise spectrum of equal power density per frequency interval ("white noise"), said noise spectrum being produced immediately before the signal transmission and being simultaneously stored in the transmitter and in the receiver to be used for the signal transmission and being scanned in the transmitter for the purpose of coding and in the receiver for decoding the signals to be transmitted with reduced band width as well as time-delayed, the time basis of the transmitter and the receiver being the same. The storage of the noise spectrum in the transmitter base and the receiver station and the release of a signal transmission process is accomplished by program control in such a way that a noise spectrum is produced and stored only after releasing the transmission process, but before transmitting the first signal of a sequence of signals.

The method according to the invention is especially suitable for the coding of guidance signals being transmitted from a control center to a self-propelled body in order to guide said body into a target. Since such a body is generally launched from the control center, a noise spectrum can be easily stored just before launching both in the transmitter of the control center and in the receiver of the body to be guided. Said noise spectrum is produced preferably after operating an actuating means causing the launching of the body and decoding of the guidance signals to be transmitted.

A disclosure of such a random code is impossible, because the code being different for each signal communication does not yet exist before establishing a signal communication. Decoding of the specific code used is nearly impossible during signal transmission because of the short time available and in consideration of the unknown type of the code.

The method according to the invention will now be described in detail by means of a signal-transmission equipment for guided missiles.

The signals required for correcting an observed deviation of such body from the path to its target are produced in control center L being only schematically shown in the drawing. Said control center L mainly consists of command generator 1, coding device 4 being controlled through time stage 2 and storage stage 3, and of transmitter 5.

Body F, which is only schematically shown, too, in the drawing and which has to be guided through control center L, carries a receiver 7 as well as a decoding device 10 and servo mechanism 11 of the control surfaces, said decoding device 10 being controlled through time stage 8 in co-operation with storage stage 9.

Moreover, a code generator C is available in the place of the control center which code generator is only schematically shown, too, and which is mainly composed of a launching program unit 13 and a noise generator 16, said launching program unit 13 controlling gate circuits 14 and 15. Wire 18 connects the launching program unit with command generator 1, wire 19 connects gate circuit 14 with storage stage 3 of control center L, and wire 20 connects gate circuit 15 with storage stage 9 of the body to be guided. Moreover, a wire 21 connects said body with the launching program unit in order to supply a release signal to the launching program unit when the body is started. Plug-in connection 22 provides that, when launched, body F can disconnect from code generator C.

The described system works as follows: If body F to be guided is ready for launching and code generator C, i.e. noise generator 16, is switched in, launching program unit 13 is released by actuating a launching button which is not shown here. Said launching program unit 13 controls the start of the body F to be guided, the production of the code and its storage immediately before launching. For this purpose the launching program unit generates a start pulse for the body, then — after the release signal over wire 21 indicates that the body is beginning to launch — gate circuits 14 and 15 are opened for a preset time, and thus an arbitrary noise spectrum of equal power density per frequency interval is taken from a permanently oscillating noise generator 16. This noise spectrum is simultaneously supplied to storage stage 3 in control center L and to storage stage 9 in body F through wire 19 and 20. At this, time stage 2 in control center L and time stage 8 in body F are released and synchronized, too. Finally, the hitherto blocked control generator 1 in control center L is released, and then the body to be guided is launched and disconnects from the code generator, the signal generation being accomplished in the known way by control generator 1.

The signals produced by the now released command generator 1 are supplied to coding device 4 before transmission, the signal produced by command generator 1 depending, for instance, on manual actuation. The signals are coded in coding device 4 by means of the code in storage stage 3 in a known manner, said code being questioned time-delayed and with reduced band width under the control of time stage 2.

After their coding according to any known method the signals are emitted through transmitter 5 to the body to be guided. Here the coded signals received through receiver 7 are decoded in decoding device 10 in a way also known. The decoding code for this purpose is taken from storage stage 9 under the control of time stage 8 in the same way as described for the control center. The decoded signals are then transmitted to the servo mechanism 11 of the control surfaces and are here transformed into the desired deflections of the control surfaces of the body to be guided.

The storages in the control center and in the receiver can be constructed as magnetic-tape storages, as magnetic-foil storages or preferably as ferrite-core storages, while the time stages should be preferably constructed as quartz-stabilized oscillators.

If a time of for instance 100 ms is assumed as storage time for a noise band width of 100 kilocycles per second the questioning time for transmitter and receiver corresponding to the maximum guidance time of a body to be guided should be prolonged to 50 seconds and the band width for questioning should be limited to some 200 c.p.s. To the same extent as the noise band width is increased for storage, either the storage time can be shortened or the questioning time or band width can be increased, when the storage time remains constant.

What I claim is:

1. In a system for the coding of guidance signals which are produced at a control center and after their coding transmitted to a body to be guided, a control center consisting of a command generator for producing the guidance signals, a coding unit for coding the guidance signals, a storage stage feeding the coding unit, said storage stage being controlled by a time stage, and a transmitter for transmitting the coded guidance signals to the body to be guided for actuating control surfaces therein, furthermore a receiver for the transmitted guidance signals, which receiver is arranged in the body to be guided, a decoding unit coupled to the receiver, a servo mechanism of the control surfaces of the body coupled to the decoding unit, a storage stage coupled to feed the decoding unit, a time stage coupled to control the storage stage, and a code generator consisting of a noise generator and two gate circuits connected therewith, one of said gate circuits being connected to the storage stage of the control center and the other gate circuit being connected to the storage stage in the body to be guided, which last connection is provided with a releasable plug which disconnects said other gate circuit when the body to be guided is launched.

2. In a system for the coding of guidance signals which are produced at a control center and after their coding transmitted to a body to be guided by actuation of control surfaces therein, a control center consisting of a command generator for producing the guidance signals, a coding unit for coding the guidance signals, a storage stage feeding the coding unit, a time stage controlling said storage stage, and a transmitter for transmitting the coded guidance signals to the body to be guided, furthermore a receiver for the transmitted guidance signals, which receiver is arranged in the body to be guided, a decoding unit connected to said receiver, a servo mechanism of the control surfaces of the body connected to said decoding unit, a storage stage connected to feed said decoding device, a time stage connected for controlling said storage stage, noise generator means connected for storing noise spectra in both said storage stages, said time stages controlling their coordinated storage stages both in the control center and in the body to be guided in such a way that the noise spectra stored there are supplied time-delayed with equal time basis to the coding unit and the decoding unit, respectively, and a code generator consisting of said noise generator and two gate circuits coupled to feed code signals, one of said gate circuits being connected to the storage stage of the control center and the other gate circuit being connected to the storage stage in the body to be guided, which last connection is provided with a releasable plug which is released when the body to be guided is launched.

3. In a system for the coding of guidance signals which are produced at a control center and after their coding transmitted to a body to be guided by actuation of control surfaces therein, a control center consisting of a command generator for producing the guidance signals, a coding unit for coding the guidance signals, a storage stage feeding the coding unit, a time stage controlling said storage stage, and a transmitter for transmitting the coded guidance signals to the body to be guided, furthermore a receiver for the transmitted guidance signals, which receiver is arranged in the body to be guided, and contains a decoding unit and a servo mechanism of the control surfaces of the body connected to the receiver, a storage stage feeding said decoding unit, a time stage controlling the storage stage, and a code generator consisting of a noise generator and two gate circuits, one of said gate circuits being connected to feed the storage stage of the control center and the other gate circuit being connected to feed the storage stage in the body to be guided, which last connection is provided with a removable plug which is released when the body to be guided is launched, as well as a launching program unit supplying release pulses to both the said gate circuits and the command generator in the said control center, and a removable plug unit disconnecting the program unit from the body at the moment of launching.

4. In a system for the coding of guidance signals which are produced at a control center and after their coding transmitted to a body to be guided by actuation of control surfaces therein, a control center consisting of a command generator for producing the guidance signals, a coding unit for coding the guidance signals, a storage stage feeding the coding unit, a time stage controlling said storage stage, and a transmitter for transmitting the coded guidance signals to the body to be guided, furthermore a receiver for the transmitted guidance signals, which receiver is arranged in the body to be guided and includes a decoding unit and a servo mechanism of the control surfaces of the body connected to receive signals, a storage stage feeding the decoding unit a time stage controlling the storage stage, a noise generator connected to store noise spectra in said storage stages in both said transmitter and receiver, both said time stages controlling their coordinated storage stages respectively in the control center and in the body to be guided in such a way that the noise spectra stored there are supplied time-delayed with equal time basis to the coding unit and the decoding unit, respectively, and a code generator consisting of said noise generator and two gate circuits, one of said gate circuits being connected to the storage stage of the control center and the other gate circuit being connected to the storage stage in the body to be guided, which last connection is provided with a removable plug connection being released when the body to be guided is launched, as well as a launching program unit supplying release pulses to both the said gate circuits and the command generator in the said control center, and a removable plug connection releasing said launching program unit from the body at the moment of launching.

* * * * *

UNITED STATES PATENT OFFICE

CERTIFICATE OF CORRECTION

Patent No. 4,102,521 Dated July 25, 1978

Inventor(s) JOACHIM HERMANN

It is certified that error appears in the above-identified patent and that said Letters Patent are hereby corrected as shown below:

In the heading of the patent [30] should read as follows:

[30] Foreign Application Priority Data:

Oct. 20, 1961....Germany.....B 64456 IXd/21a$^4$

Signed and Sealed this

*Sixth* Day of *February 1979*

[SEAL]

*Attest:*

RUTH C. MASON
*Attesting Officer*

DONALD W. BANNER
*Commissioner of Patents and Trademarks*